US010113379B2

(12) United States Patent
Calderoni

(10) Patent No.: US 10,113,379 B2
(45) Date of Patent: Oct. 30, 2018

(54) METHOD OF ASSEMBLY OF A STRING OF ELEMENTS FOR DEEPWATER DRILLING AND ULTRADEEP OBSTRUCTION ELEMENT AND CORRESPONDING USE OF THE SAME IN SAID DRILLING STRING

(71) Applicant: DRILLMEC SPA, Gariga di Podenzano (PC) (IT)

(72) Inventor: Angelo Calderoni, Gariga di Podenzano (IT)

(73) Assignee: DRILLMEC S.P.A., Gariga di Podenzano (PC) (IT)

( * ) Notice: Subject to any disclaimer, the term of this patent is extended or adjusted under 35 U.S.C. 154(b) by 0 days.

(21) Appl. No.: 15/129,346

(22) PCT Filed: Mar. 13, 2015

(86) PCT No.: PCT/IB2015/051839
§ 371 (c)(1),
(2) Date: Sep. 26, 2016

(87) PCT Pub. No.: WO2015/145293
PCT Pub. Date: Oct. 1, 2015

(65) Prior Publication Data

US 2017/0107774 A1 Apr. 20, 2017

(30) Foreign Application Priority Data

Mar. 26, 2014 (IT) ..... TO2014A0249

(51) Int. Cl.
*E21B 7/12* (2006.01)
*E21B 19/16* (2006.01)
(Continued)

(52) U.S. Cl.
CPC ..... *E21B 21/10* (2013.01); *E21B 7/12* (2013.01); *E21B 7/128* (2013.01); *E21B 19/002* (2013.01);
(Continued)

(58) Field of Classification Search
CPC ..... E21B 7/12; E21B 19/002; E21B 19/16; E21B 21/001; E21B 21/10; E21B 34/06; E21B 47/09; E21B 2034/005
See application file for complete search history.

(56) References Cited

U.S. PATENT DOCUMENTS 2,204,340 A * 6/1940 Bradshaw ..... E21B 21/10 137/515.5
3,298,385 A 1/1967 Jackson et al.
(Continued)

FOREIGN PATENT DOCUMENTS

EP 0 697 501 A2 2/1996

OTHER PUBLICATIONS

International Search Report and Written Opinion from corresponding International Patten Application No. PCT/IB2015/051839, dated Jun. 5, 2015.

*Primary Examiner* — Matthew R Buck
(74) *Attorney, Agent, or Firm* — Merchant & Gould P.C.

(57) ABSTRACT

A method of assembly is for a string of drilling elements for deepwater drilling. Each drilling element includes an axial through hole, through which drilling mud can flow, and two connection portions for connecting it in series in the string. The method includes assembling a lower portion of the string, assembling a first drilling element with other drilling devices to create a first section of the string. These steps are repeated until the lower portion is proximate the blowout preventer or the bottom. Assembly of second drilling elements begins while executing a drilling cycle for creating at
(Continued)

least a second section of the string. The assembly step is repeated until the second section extends equal to a desired drilling depth. After assembling the lower portion and before assembling the first drilling element, a third drilling element is assembled, which includes an obstruction element for preventing backflow in the string.

17 Claims, 6 Drawing Sheets

(51) Int. Cl.

| | |
|---|---|
| ***E21B 21/10*** | (2006.01) |
| ***E21B 34/08*** | (2006.01) |
| ***E21B 7/128*** | (2006.01) |
| ***E21B 19/00*** | (2006.01) |
| ***E21B 21/00*** | (2006.01) |
| ***E21B 34/06*** | (2006.01) |
| ***E21B 47/09*** | (2012.01) |
| *E21B 34/00* | (2006.01) |

(52) U.S. Cl.
CPC ..... *E21B 19/16* (2013.01); *E21B 21/001* (2013.01); *E21B 34/06* (2013.01); *E21B 34/08* (2013.01); *E21B 47/09* (2013.01); *E21B 2034/005* (2013.01)

(56) References Cited

U.S. PATENT DOCUMENTS 3,419,040 A * 12/1968 Thibodeaux ..... E21B 21/10 137/515.7
3,783,942 A * 1/1974 Mott ..... E21B 21/10 166/323
3,861,470 A * 1/1975 Mott ..... E21B 21/10 137/461
4,712,613 A * 12/1987 Nieuwstad ..... E21B 21/10 166/187
6,196,261 B1 3/2001 Dennistoun
6,904,981 B2 * 6/2005 van Riet ..... E21B 21/08 166/265
7,107,875 B2 * 9/2006 Haugen ..... E21B 3/04 81/57.15
7,287,598 B2 * 10/2007 Adams ..... E21B 19/002 166/382
7,726,418 B2 * 6/2010 Ayling ..... E21B 19/16 137/515
8,342,249 B2 * 1/2013 Payne ..... E21B 7/12 166/351
2005/0284547 A1 * 12/2005 Strattan ..... B22D 31/002 148/556
2007/0215356 A1 * 9/2007 Leeb ..... E21B 21/10 166/325
2007/0246221 A1 * 10/2007 Jones ..... C09K 8/145 166/358
2012/0067595 A1 * 3/2012 Noske ..... E21B 23/02 166/373
2013/0175045 A1 * 7/2013 Rytlewski ..... E21B 33/0355 166/363
2013/0175094 A1 * 7/2013 Ross ..... E21B 23/00 175/57
2015/0308205 A1 * 10/2015 Arnt ..... E21B 21/08 175/5

* cited by examiner

METHOD OF ASSEMBLY OF A STRING OF ELEMENTS FOR DEEPWATER DRILLING AND ULTRADEEP OBSTRUCTION ELEMENT AND CORRESPONDING USE OF THE SAME IN SAID DRILLING STRING

This application is a National Stage Application of International Patent Application No. PCT/IB2015/051839, filed 13 Mar. 2015, which claims benefit of Serial No. TO2014A000249, filed 26 Mar. 2014 in Italy and which applications are incorporated herein by reference. To the extent appropriate, a claim of priority is made to each of the above disclosed applications.

BACKGROUND OF THE INVENTION

The present invention relates to a method of assembly of a string of drilling elements, such as, for example, drill pipes, in which at least one obstruction element is inserted as a safety device, for drilling wells for oil-field exploration and development in deep and ultra-deep waters, such as seas or watersheds. The present invention further relates to an obstruction element acting as a safety device and to the use thereof in said string of said drilling elements.

The obstruction element acting as a safety device, which is inserted in the drill string according to the present invention, protects the environment and the life of the crew of a drilling rig, because it prevents an uncontrolled outflow of layer fluids, also known as blowout, through the inside of the drilling elements, e.g. drill pipes.

The obstruction element acting as a safety device according to the present invention operates automatically and ensures that the pipes will be closed internally. Moreover, during the well drilling cycle said obstruction element is positioned under the blowout preventer (BOP), thus ensuring that the shear rams comprised in BOP will be able to cut the pipe properly and sharply, since the drilling element or pipe will not be concerned by an anomalous internal pressure that might adversely affect the cutting.

For the purposes of the present invention, the term deepwater drilling relates to a drilling process carried out into the bed of a sea, an ocean or a watershed in general, the depth of said bed being at least 550 m, whereas ultra-deepwater drilling refers to a depth of at least 1500 m from the water level.

It is known that in deepwater drilling, in particular in very deep waters, the actual drilling of the bottom or bed occurs after a string of drilling elements or pipes has already been assembled, the length of which equals the depth of the bottom or bed. Other drilling elements are then added to this first string of elements to allow the drilling rig to execute the drilling cycle, as known to the man skilled in the art.

By way of example, in order to drill 1500 m with a water depth of 1000 m from sea level, it will be necessary to assemble a 2500 m pipe string.

It is also known that, in deepwater drilling, the blowout preventer (BOP) for preventing an undesired outflow of hydrocarbons from a drilling well, is positioned on the bottom or bed, i.e. very distant from the drill floor where the drilling elements are assembled to form the string.

In the drilling field, all those who design and drill wells rely on the concept that at least two independent and tested safety barriers must be available. In most cases, the two safety barriers respectively consist of: the circulating drilling mud, the gradient of which is higher than the gradient of the pores of the formation being crossed; and the safety equipment installed and tested at the wellhead.

For the purposes of the present invention, the term wellhead relates to the point where the drilling well begins, which in deepwater drilling is on the bottom or bed of the watershed.

In the technical jargon used in the oil well drilling industry, the safety equipment essentially consists of the blowout preventer (BOP).

Current BOP's can hold operating pressures in the range of 3,000 to 15,000 psi, i.e. 20.68 MPa to 103.4 MPa, in deepwater drilling. For ultra-deepwater drilling, BOP's are typically used which work at pressures in the range of 10,000 to 15,000 psi, i.e. 68 MPa to 103.4 MPa. BOP's include a set of clamping devices, such as rams, to clamp the drilling elements, and a plurality of shearing elements to shear the drilling elements. In particular, a BOP for deepwater use comprises at least three profiled rams, one blind ram, and one or two shear rams, which close the wellhead. Said BOP also comprises closing elements called annulars, which can exert a pressure in the range of 5,000 to 10,000 psi, i.e. approx. 34.47 MPa to 68.93 MPa. Normally the device includes one upper closing element, or upper annular, and one lower closing element, or lower annular.

Said closing elements can close any drilling element or drill pipe of any common size, and can even exert a blind closing action by closing the through hole comprised in said drilling element, as is known to a man skilled in the art.

In the prior art, shear rams have been introduced for offshore activities on semi-submersible craft and drill ships, for the purpose of being able to shear the pipes in dangerous situations and move away with the drilling craft, leaving at the bottom of the sea a well closed at its head by safety equipment.

Said hydrocarbon blowout preventer or BOP normally comprises an upper portion and a lower portion. Said upper portion is separable from the lower portion, which will remain on the bottom or bed, integral with the wellhead. This separation of the BOP into two portions allows safeguarding the life of the crew aboard the floating craft or structure normally employed for deepwater drilling, while at the same time ensuring a safe closing of the well.

Said removed upper portion of the BOP can be reconnected to the safety system left at the wellhead, and drilling activities can then be resumed.

The cutting of the well pipes effected by the shear rams of the BOP is considered to be the last action that should be taken because, by so doing, hydraulic contact with the well will be lost and all actions aiming at restoring the normal safety and working conditions at the well will then be precluded. It follows that, if this extreme action is the only option that is left, the BOP will need to be in the best conditions for performing the cutting.

It is known that the BOP ensures the best cutting results on drilling elements or drill pipes in the well when inside said pipes there is the nominal working pressure, i.e. no anomalous pressure.

For the purposes of the present invention, the term anomalous pressure refers to a pressure higher than the pressure which is present inside the drilling elements during the drilling cycle. In particular, an anomalous pressure is a pressure higher than the maximum drilling mud intake pressure.

Said anomalous pressure normally causes an uncontrolled outflow of hydrocarbons, or blowout. In particular, if blowout occurs through the inside of the drill pipes, the BOP device will not operate in optimal working conditions. It can therefore be presumed that the shear rams will not be able to cut the pipe with anomalous internal pressure and to properly seal the well. Moreover, depending on the reservoir pressures, the value of the pressure inside the drill pipes may vary considerably.

The actual trend is to build increasingly powerful and robust prevention systems or BOP's, even including two shearing parts, without however paying attention to the above-mentioned concept, according to which it must be ensured that, during the step of shearing the drilling elements, the pressure conditions inside the pipes must be such as to allow the shear rams to work in the best operating conditions.

Therefore, notwithstanding the high power of these new prevention devices or BOP's, problems might be easily encountered while cutting pipes in high-pressure and high-temperature well conditions, also known as HP/HT.

It is also known to use a valve assembly in series with the through hole of the drilling element of a drill string, aiming at preventing the drilling mud, during continuous mud circulation, from flowing out on the drill floor while adding or removing one or more drilling elements to/from said string, as described, for example, in U.S. Pat. No. 3,298,385.

It is known from US patent application US2013/175045 A1 a method for pressurizing a hydraulic accumulator includes creating an annulus pressure zone in hydraulic communication with the hydraulic accumulator through a hydraulic recharging circuit and applying a hydraulic pressure to the annulus pressure zone. Operating the hydraulic recharging circuit in response to applying the hydraulic pressure and pressurizing the hydraulic accumulator in response to operating the hydraulic recharging circuit.

It is also known from US patent application US2005/284547 A1 components of a subsurface safety valve which are cast instead of machined for dramatic cost savings. In particular, the flapper is cast from a 718 nickel alloy and treated with the HIP process to increase strength and corrosion resistance while reducing porosity. Other downhole valve components are contemplated to be produced by the same technique and the materials can also be varied. Depending on the specific alloys, the resulting HIP components are either superior in performance (e.g. strength, corrosion resistance) or considerably cheaper to manufacture than their wrought counterparts.

The European patent application EP0697501 discloses Integrated drilling and evaluation system for drilling, logging and testing a well comprises a drill string (18A), a drill bit (30) carried on a lower end of the drill string for drilling a well bore, logging while drilling means (28) included in the drill string for identifying subsurface zones of formations (16) of interest, packer means (24) carried on the drill string above the drill bit (30) for sealing a zone or formation (16) of interest below the packer means (24), and a fluid testing means (22) included in the drill string for controlling the flow of well fluid from the zone or formation of interest into the drill string. The system allows one or more subsurface zones or formations (16) of interest in a well to be drilled, logged and tested without the necessity of removing the drill string (18A) from the well.

At last, the U.S. Pat. No. 6,196,261 discloses a flapper valve assembly (120) for controlling fluid flow therethrough is disclosed. The flapper valve assembly (120) comprises a tubular valve housing having a valve chamber. A valve seat (124) is mounted within the housing. The valve seat (124) has a valve seat sealing surface (126). The valve seat (124) also has an internal load bearing shoulder (134). A flapper closure plate (122) is rotatably disposed within the valve chamber. The flapper closure plate (122) is rotatable between a valve open position in which the flapper closure plate (122) is removed from the valve seat (124) and a valve closed position in which the sealing surface (128) of the flapper closure plate (122) sealingly engages the valve seat sealing surface (126) for preventing flow through the flapper valve assembly (120). The maximum travel of the flapper closure plate (122) in the closed position is defined by the internal load bearing shoulder (134) of the valve seat (124).

SUMMARY OF THE INVENTION

The present invention aims at solving the above-mentioned technical problems by implementing a method of assembly of drill pipes and an obstruction element, and the use thereof, in accordance with the present invention, thereby ensuring that inside the drilling element, at wellhead level, there will always be a pressure that will allow the BOP device to operate in the best working conditions, should it be necessary to shear any drilling elements in order to secure a drilling well for hydrocarbon exploration.

One aspect of the present invention relates to a method of assembly of drill pipes for deepwater and/or ultra-deepwater drilling.

Another aspect relates to an obstruction.

A further aspect of the present invention relates to the use of an obstruction element comprised in drilling elements for deepwater and/or ultra-deepwater drilling.

BRIEF DESCRIPTION OF THE DRAWINGS

The features and advantages of the method, of the obstruction element and of the use thereof will become apparent from the following description of at least one exemplary and non-limiting embodiment of the method of assembly, of the obstruction element and of the use thereof, as well as from the annexed drawings, wherein:

in FIG. 2B the obstruction element is shown in a second configuration, wherein it clears the axial hole of the drilling element with which it is associated, thus not obstructing it and re-establishing the passage that was obstructed in the first operating condition, thereby allowing the circulation of a flow of drilling mud towards the well bottom;

FIG. 3A schematically shows the nominal flow within the drilling device during a drilling cycle, whereas FIG. 3B schematically shows the flow during a blowout inside the drilling element;

FIG. 5A shows a first section of the obstruction element relative to the plane 5A-5A, whereas FIG. 5B shows a second section thereof relative to the plane 5B-5B, wherein one can see the position of the obstructor in the cavity.

DETAILED DESCRIPTION

Figure 1:
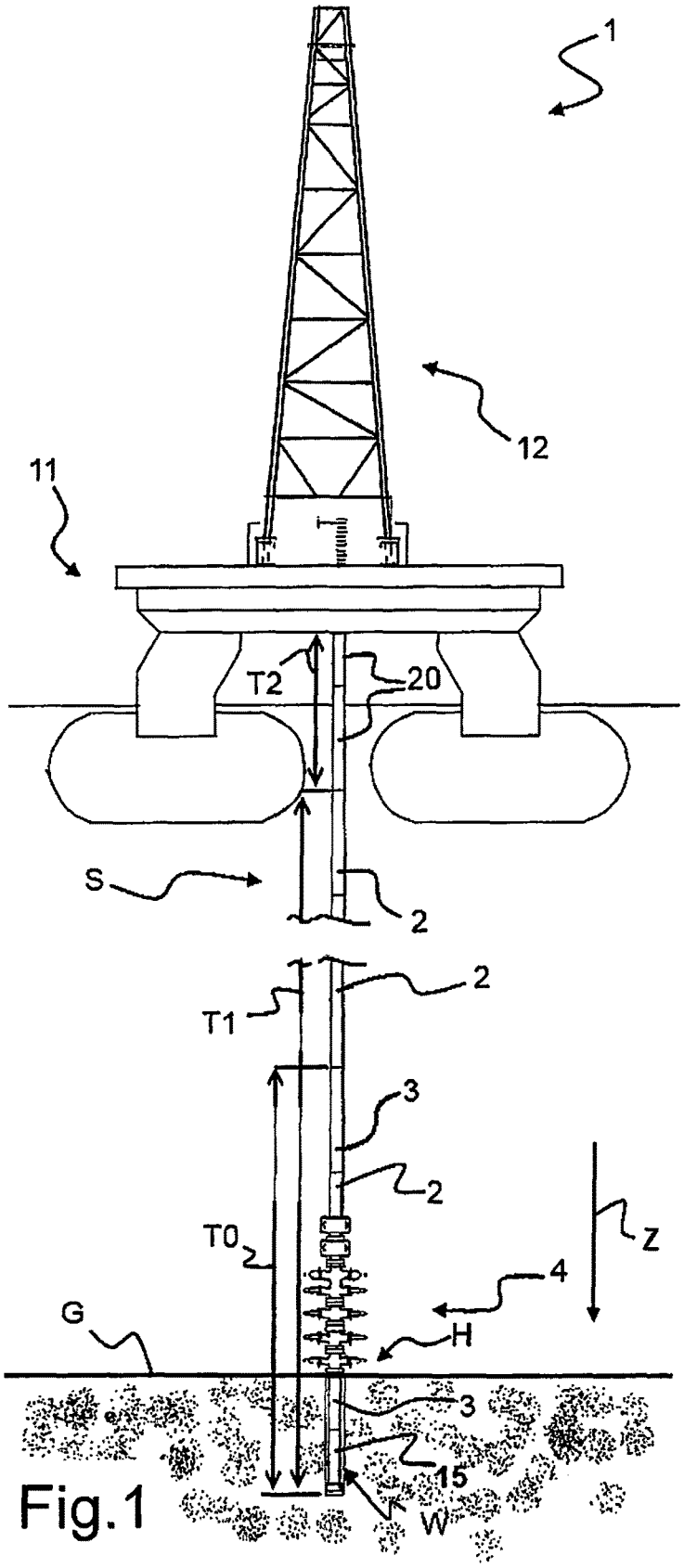
FIG. 1 shows a typical apparatus for deepwater or ultra-deepwater drilling, in particular a rig comprising a floating station whereon a derrick is placed, above sea level, and a safety device placed on the bottom or bed of the watershed or sea, and a set of drill pipes running for the entire depth of the watershed or sea down into the wellbore.

The above-mentioned drawings illustrate the method of assembly of a string "S" of drilling elements, which string is specific for drilling oil wells "W" in deep and/or ultra-deep waters, e.g. into the bottom of seas, oceans or lakes.

In the method according to the present invention, each drilling element, which can be assembled in series into string "S", comprises at least one axial through hole 21, through which drilling mud "M" can at least flow in a first direction. Said first direction is concordant with the longitudinal axis "Z", as shown by way of example in FIG. 3A. Said drilling mud "M" is directed towards the bottom of well "W".

Each one of said drilling elements comprises at least two connection portions 23 for allowing the same drilling element to be connected in series in said string "S", particularly to other drilling elements.

The method of assembly of a string "S" of drilling elements for deepwater drilling according to the present invention comprises the following steps:

a) assembling a lower portion of string 15, e.g. the bottom hole assembly (BHA) comprising a drill bit, drill collars (DC) and any stabilizers;

b) Taking at least one first drilling element 2 from a housing;

c) Assembling said at least one first drilling element 2 with other first drilling elements, e.g. the lower portion of string 15 or other drilling elements 2, in order to create a first section "T1" of string "S" comprising said first drilling elements 2 directed towards a bottom or bed "G", in particular directed towards the place where a blowout preventer or BOP 4 is located, where well "W", and hence wellhead "H", will be made;

d) Repeating steps b)-c) until the lower portion 15 arrives in the proximity of blowout preventer or BOP 4 or in the proximity of bottom or bed "G";

e) Beginning the assembly of second drilling elements 20 while a drilling apparatus 1 is carrying out a drilling cycle, for the purpose of creating at least a second section "T2" of string "S";

f) Repeating step until the second section "T2" has reached an extension at least equal to a desired drilling depth.

The method according to the present invention envisages the execution, after step a) and before step b), of at least one step s), wherein at least one third drilling element 3 is assembled into said string, which element comprises at least one obstruction element 5.

The method according to the present invention also envisages the execution, while carrying out the sequence of steps b)-d), preferably extremes included, of at least one further step s), wherein at least one third drilling element 3 is assembled into said string, which element comprises at least one obstruction element 5. Said obstruction element 5 prevents a backflow "B", in particular a flow opposite to the predetermined direction of drilling mud "M", from being generated in said string "S". The direction of drilling mud "M" towards the bottom of well "W" is imposed by a mud circulation system, not shown in detail. In general, said obstruction element 5 prevents the generation of a backflow "B" by obstructing said axial hole 21 of the drilling element with which it is associated.

With this sequence of steps, at the beginning of the drilling cycle carried out by a drilling apparatus 1, i.e. when the actual drilling activity starts for making a well "W", said third drilling element 3 is placed at least at the blowout preventer or BOP 4, or downstream of it towards the bottom of well "W". More preferably, the method is executed in a manner such that, at the beginning of the drilling cycle carried out by a drilling rig 1, said third drilling element 3 is placed at such a depth as to be located downstream of at least one first shearing device comprised in the blowout preventer or BOP 4, in particular such that said obstruction element 5 is located downstream of at least one first shearing device. Such an arrangement ensures that, should a backflow "B" tend to propagate within the drilling elements through axial hole 21, near a shearing device of the blowout preventer or BOP 4 there will be a known pressure, lower than the nominal working pressure, preferably equal to or lower than the atmospheric pressure.

Thanks to the execution of step s) in the method according to the present invention, at least one third element 3 is interposed, in series along string "S", between initial portion 15 and the antecedent of the first drilling elements 2 and/or between two consecutive first drilling elements 2.

As previously specified, and as will be illustrated below, in a first embodiment said initial portion 15 may be the assembly referred to as bottom hole assembly or BHP, comprising a drill bit, drill collars, stabilizers, etc., as known to those skilled in the art. In equivalent embodiments, said initial portion 15 is a drill pipe, as known to those skilled in the art.

For the purposes of the present description, the term drilling apparatus 1 for deepwater or ultra-deepwater drilling refers to an apparatus for drilling oil wells, comprising a structure floating on water, in turn comprising a drill floor whereon a mast 12 is arranged, as shown in FIG. 1 and as known to a man skilled in the art.

With string "S" of drilling elements obtained by using the method according to the present invention, in the event of a reversal of the direction of the flow inside the drilling elements, said obstruction element 5 will be able to take, preferably automatically, a first configuration in which it will obstruct axial hole 21 of the third drilling element 3 with which it is associated. In particular, should a rising backflow "B" be generated along string "S" of drilling elements, e.g. towards floating structure 11, which backflow "B" might cause an undesired blowout of hydrocarbons, said obstruction element 5 will obstruct, by taking said first configuration, axial hole 21 of the third drilling element 3 with which it is associated, thereby preventing backflow "B" from propagating past head "H" of well "W", where the blowout preventer or BOP 4 is located, or even up to the drill floor.

Figure 3A:
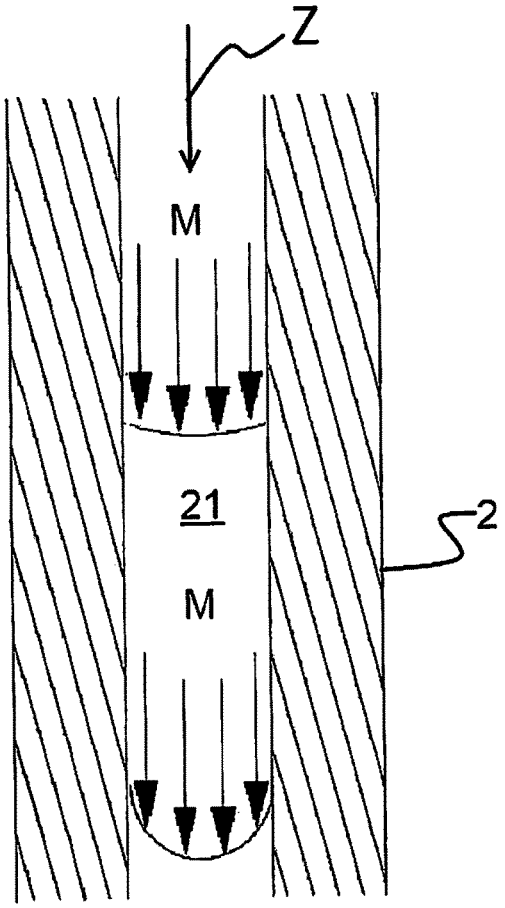
FIGS. 3A and 3B show the flow within a drilling element in two different conditions.
Figure 3B:
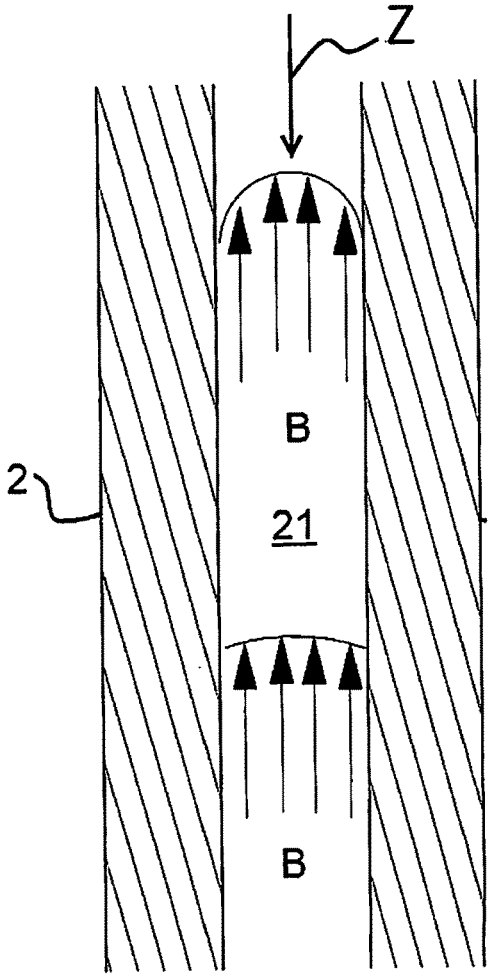

FIG. 3B shows a backflow "B" tending to go up along string "S" through axial hole 21 of drilling elements 2, towards floating structure 11. Thanks to the method of assembly of string "S" according to the present invention, obstruction element 5 comprised in the third drilling elements 3 will cause backflow "B" to be at least partially attenuated at least at the level of head "H" of drilling well "W", so that blowout preventer or BOP 4 will be allowed to operate in optimal working conditions. In string "S" of drilling elements obtained by using the method according to the present invention, in fact, due to said obstruction element 5 the pressure in axial hole 21 at the level of blowout preventer or BOP 4 can at most be equal to the nominal working pressure, i.e. the pressure of drilling mud "M" used during the drilling cycle carried out by apparatus 1. In particular, FIG. 3B shows a kick, i.e. layer fluids entering the well. This event is the very critical condition that can be limited by the method of the present invention, by preventing it from propagating and allowing the safety mechanisms to limit its possible catastrophic effects, thus demonstrating the inventiveness of the present invention.

In particular, prior to the activation of the shearing elements of a blowout preventer or BOP 4, the pressure within the drilling elements is lower than the nominal working pressure, preferably substantially equal to or lower than the atmospheric pressure.

The same obstruction element 5, when drilling apparatus 1 is in normal operating conditions, e.g. during said drilling cycle, is in a second configuration in which it does not obstruct axial hole 21 of the third drilling element 3 with which it is associated, thus allowing drilling mud "M" to flow towards the bottom of drilling well "W". When a flow direction reversal occurs, i.e. when in hole 21 of the drilling elements there is a backflow "B", said obstruction element 5 will switch from the second operating configuration to said first operating configuration, preferably automatically, thereby obstructing the axial hole of the third drilling element 3 with which it is associated. When said obstruction element switches into the first configuration, it will block, at least partially, undesired backflow "B", thus at least limiting the propagation thereof.

For descriptive purposes, FIGS. 3A and 3B show the directions of the flows within a first drilling element 2, so that they can be compared. Such flows can be found in any drilling device.

The method according to the present invention allows preventing backflow "B" from propagating along the drilling elements, in particular past head "H" of well "W".

Preferably, the method according to the present invention envisages that said further step s) is carried out at regular intervals, so that said third drilling element 3 comprising said obstruction element 5 will be interposed between two first drilling elements 2 at known intervals, i.e. at predefined distances, preferably at regular distances. In particular, the distance between two third drilling elements 3 is comprised between 30 m and 500 m, preferably between 300 m and 500 m, as will be considered appropriate by the operator.

Figure 6:
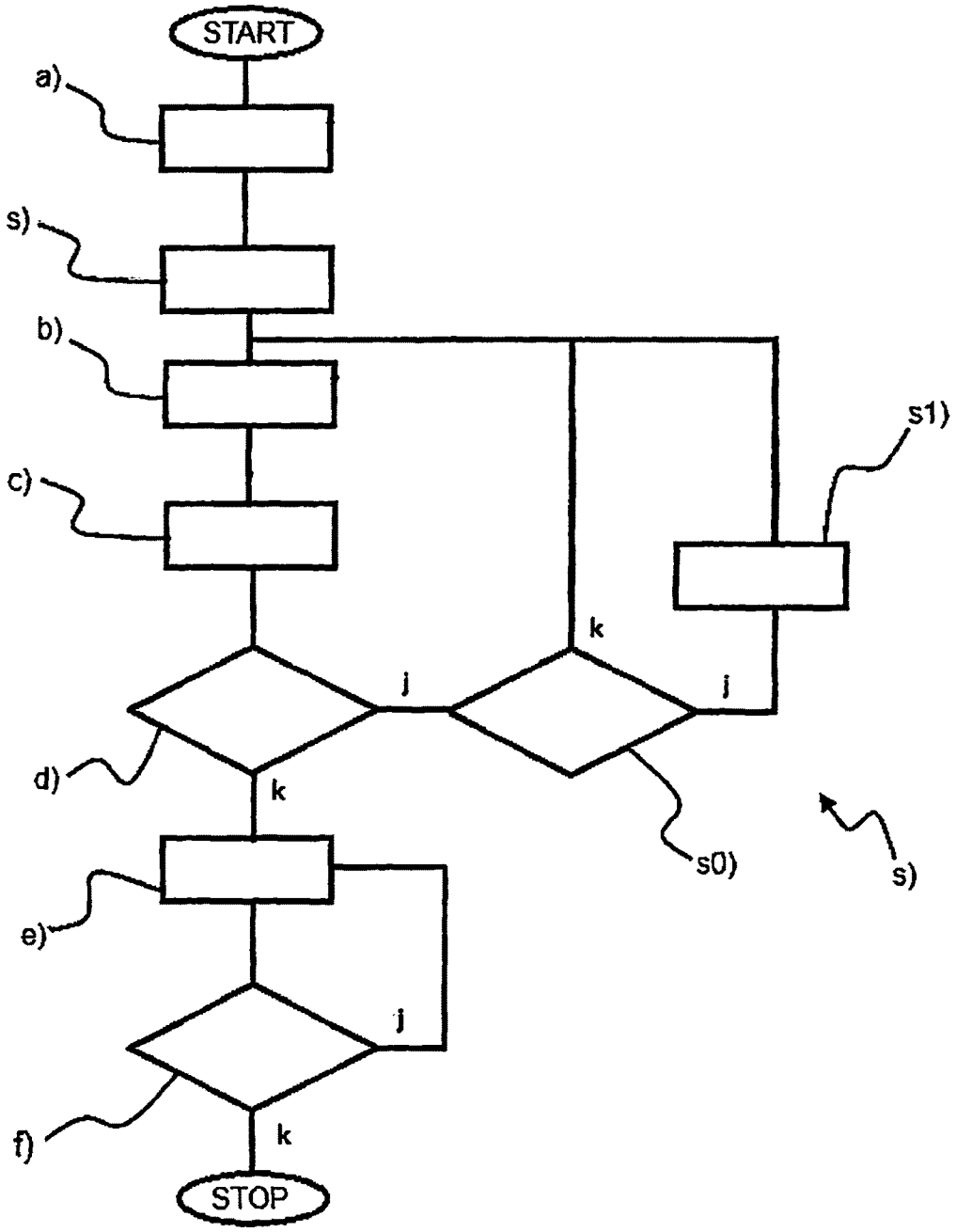
FIG. 6 shows by way of example a flow chart of the method of assembly of drilling elements for deepwater drilling in accordance with the present invention.

FIG. 6 shows an exemplary and non-limiting flow chart of a sequence of steps for assembling a string "S" of drilling elements for deepwater drilling.

In step a) of assembling the lower portion of string 15, e.g. the bottom hole assembly or BHA, the drill bit, the drill collars and the other elements making up the bottom hole assembly or BHA are assembled together and become the first elements of the string "S", as known to those skilled in the art.

The lower portion of string 15 is thus the first part of string "S" that will be immersed into the water towards prevention device 4, where drilling well "W" will be made.

After step a) and before step b), at least one step s), preferably only one step s), is carried out.

During said step s), a third drilling element 3 is assembled to said lower portion of string 15, e.g. to the bottom hole assembly or BHA; in particular, a third drilling element 3 is inserted. In said step s) a third drilling element 3 is assembled in series to string "S". In particular, at this stage of the method a third drilling element 3 is assembled in series to lower portion 15 of string "S".

Step s) comprises an intermediate step (not shown) of taking said third drilling element 3, e.g. from a pipe container.

When step s) is completed, step b) is carried out.

In step b) of taking at least one first drilling element 2 through handling systems known to a man skilled in the art, said first drilling elements 2, stored in a housing, e.g. a pipe container (not shown), are placed near a drilling device or kelly, not shown in the drawings.

Step b) is followed by step c) of assembling said at least one first drilling element 2 together with other drilling devices.

In the first execution of step c) of the method illustrated herein, said first drilling element 2 is assembled to a third drilling element 3, which in the previous step was assembled to said lower portion of string 15, e.g. to the bottom hole assembly or BHA. In the subsequent executions of step c), the other drilling elements 2 may be assembled either to other first drilling elements 2 or to third drilling elements 3, as will become apparent below. In general, the drilling elements are assembled together through their respective connection portions 23.

The assembly of first drilling elements 2 allows creating a first section "T1" of string "S", comprising said first drilling elements 2. Said first section "T1, just like the whole string "S", is directed towards bottom or bed "G", where blowout preventer or BOP 4 is located.

Step c) is then followed by step d). Said step d) is a check step wherein it is verified if said string "S", in particular said first section "T1", has reached a known predetermined length.

In general, said step d) can verify if the assembly of said first drilling elements 2 is such that said lower portion of string 15 has reached blowout preventer 4 or bottom or bed "G".

If it is verified that said first section "T1" has not reached the predetermined length, i.e. the estimated depth of bottom or bed "G" where well "W" will be drilled, then path "j" will be taken, wherein steps b) and c) of the method will be repeated.

On the contrary, if it is verified that said first section "T1" has reached the predetermined length, i.e. that said lower portion of the string, or bottom hole assembly or BHA 15, has arrived in the proximity of blowout preventer or BOP 4, then path "k" will be followed, wherein the method will proceed to the next step e).

In general, along path "j" the method envisages, according to the present invention, the possibility of executing a step s) prior to repeating steps b) and c).

The flow chart shown in FIG. 6 refers to an embodiment of the method wherein step s) includes a first check step s0) and an execution step s1).

Said check step s0) verifies the periodicity of the execution step s1) of inserting a third drilling element 3. This process translates into verifying, along string "S", in particular along section "T1", the distance between two third drilling elements 3. In particular, step s0) verifies if the distance between two third elements 3 is less than a predetermined threshold. If the distance between two third elements 3 is below a predetermined threshold, which is set depending on the operating conditions of well "W" to be made, path "k" will be followed. Conversely, if the distance between two third elements 3 is greater than or equal to a predetermined threshold, path "j" will be followed.

Said distance threshold is a value between 28 m and 500 m, preferably between 300 m and 500 m. Said threshold may vary as a function of different parameters, such as, for example, the operating conditions of well "W", as specified below.

By following path "k", the method will arrive again at step b), which will then be repeated; instead, path "j" will lead to step s1).

By way of non-limiting example, the distance threshold between two third drilling elements 3, and hence between two obstruction elements 5, that will cause the method to follow path "j" and execute the step s1), is comprised between 28 m and 500 m, preferably multiples of 28 m or 30 m. In general, the number of third drilling elements 3, and hence of obstruction elements 5, inserted in string "S" for surpassing blowout preventer 4, in particular for surpassing wellhead "H" and entering well "W", depends on the type of well to be made and/or the type of rock and/or the type of fossil fuel reservoir and/or the sensitivity of the operator controlling the drilling cycle.

In said step s1) of inserting a third drilling element 3, a third drilling element 3 is assembled in series to string "S". As known to a man skilled in the art, said step s) comprises an intermediate step (not shown) of taking said third drilling element 3, e.g. from a pipe container.

After step s1), the process will return to step b), and the steps of the method according to the present invention will be repeated.

If path "k" is followed while executing step d), the process can go on to the next step e) of beginning the assembly of second drilling elements 20.

In an alternative embodiment (not shown), the method comprises a further check step d0), which precedes the check step d), wherein it is verified if the assembly of said first drilling elements 2 has reached an extension "T0". Said extension "T0" is at least equal to the predefined design drilling depth of well "W" for hydrocarbon exploration. Said step s) is carried out during the cycle executed from step d0). Said extension "T0" is comprised in said section "T1", constituting the initial part thereof, which will be actually inserted into well "W" and will surpass blowout preventer or BOP 4 at the end of the drilling operation carried out by apparatus 1. Said extension "T0" may be shorter than or equal to the total extension of section "T1", particularly for ultra-deepwater drilling. For deepwater drilling, said extension "T0" may also be equal to or greater than the total extension of section "T1". As aforementioned, said extension "T0" is shorter than or at most equal to the maximum design depth of well "W".

Step d0) is then followed by step d). Preferably, the cycle generated in step d) includes no step s), since it has already been carried out in the cycle generated in the check step d0). This latter embodiment of the method reduces to a minimum the number of third drilling elements 3 required, thereby reducing the costs, while however being sure that, as soon as the drilling cycle is started, at least one third element 3 will be at least at or past said blowout preventer or BOP 4, in particular it will have surpassed, while descending the well, at least one of the shearing elements comprised in BOP device 4.

In general, the method ensures that at least one third drilling element 3 is inserted in the section of string "S" that will drill well "W", preferably immediately following the initial portion of string 15, and will therefore have gone past said blowout preventer 4, thus ensuring that there will be at least one obstruction element 5 between the bottom of well "W" being drilled and wellhead "H", at the level of bottom or bed "G" where said BOP device 4 is located. The method of assembly of drilling elements according to the present invention prevents the propagation of a backflow "B" and ensures that, should a backflow "B" arise at the level of blowout preventer or BOP 4, in particular at least at a shearing device comprised in device 4, preferably the closest one to bottom or bed "G", there will be a controlled pressure, lower than the nominal working pressure, and preferably much lower than the intake pressure of drilling mud "M".

In general, the execution of step s) after step a) provides immediate stopping, or at least attenuation, of a possible propagation of a backflow "B" within the drilling elements.

Furthermore, the execution of steps d) and s) of the method of the present invention implies that said obstruction elements 5 are arranged at predefined distances from each other, so that they can cooperate together to extinguish as soon as possible a backflow "B" that might cause hydrocarbon blowout. The arrangement of third drilling elements 3, and hence of obstruction elements 5, along string "S" allows preventer 4 to be immediately put into optimal working conditions for shearing the drilling elements by means of at least one shearing device.

In general, a backflow "B" could be stopped by using a single third drilling element 3 comprising at least one obstruction element 5, e.g. the first third drilling element 3 arranged in series in string "S" immediately after initial portion 15 in extension "T0", and/or inserted between the initial first drilling elements 2 of string "S".

In general, step d) is followed by step e) of beginning the assembly of second drilling elements 20, for the purpose of creating at least one second section "T2" of string "S", as shown by way of example in FIG. 1.

Said step e) is carried out while drilling apparatus 1 is starting the drilling cycle.

For the purposes of the present invention, the term second drilling elements 20 refers to drilling elements suitable for allowing the circulation of drilling mud during all the operating stages of the drilling cycle carried out by drilling apparatus 1.

Said third drilling element 3 and said second drilling element 20 are of course different, since they perform different functions.

In ultra-deepwater and deepwater drilling, said second drilling elements 20 can hardly arrive in the proximity of blowout preventer or BOP 4, in that they will normally remain in a position along string "S" between said BOP device 4 and floating structure 11.

Said second drilling elements 20 can prevent a backflow "B" from propagating within string "S", avoiding a blowout at the level of the drill floor comprised in floating structure 11, but said second drilling elements 20 cannot ensure that at the level of blowout preventer or BOP 4 there will be a pressure within the drilling elements at most equal to the pressure of the drilling mud, preferably a very low pressure or a pressure equal to the atmospheric pressure. For these reasons, the same blowout preventer or BOP, in particular the shearing devices thereof, will not operate in optimal conditions, should their intervention be required, because of the high pressure within the drilling elements. This high internal pressure, as previously specified, might cause very serious damage due to an improperly made cutting operation.

Step e) is then followed by step f). Said step f) is a check step wherein it is verified if said string "S", in particular said second section "T2", has reached a predetermined length.

In particular, in step f) it is verified if the second section "T2" has reached an extension equal to the known predefined drilling depth specified in the design of well "W".

If during the check it is verified that said second section "T2" has not reached the predefined length, then path "j" will be followed, which will cause the method to repeat step e).

Conversely, if the check indicates that said second section "T2" has reached the predefined length, then path "k" will be followed, which will allow ending the method of assembly of drilling elements for deepwater or ultra-deepwater drilling according to the present invention because the desired drilling depth will have been reached, so that the drilling cycle carried out by apparatus 1 can be stopped.

In an alternative embodiment, said further step s) is carried out after the execution of at least two steps c), preferably while keeping a regular cadence in the execution of step s).

Figure 2A:
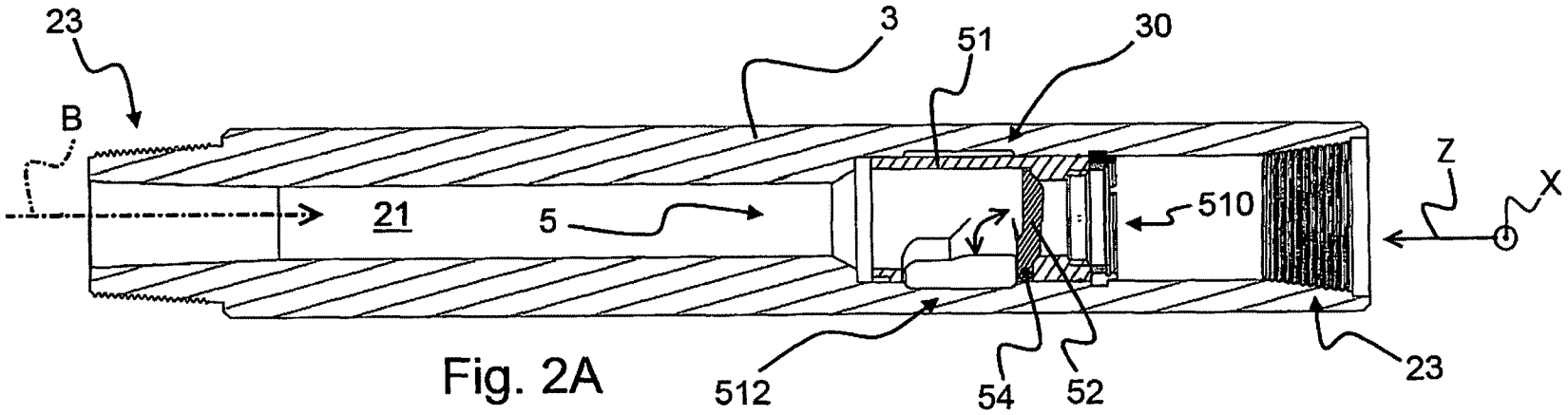
FIGS. 2A and 2B show one possible embodiment of a drilling element comprising an obstruction element in different operating configurations; in particular, in FIG. 2A the obstruction element is shown in a first configuration, wherein it obstructs the axial hole of the drilling element with which it is associated, thereby preventing the circulation of a backflow.
Figure 2B:
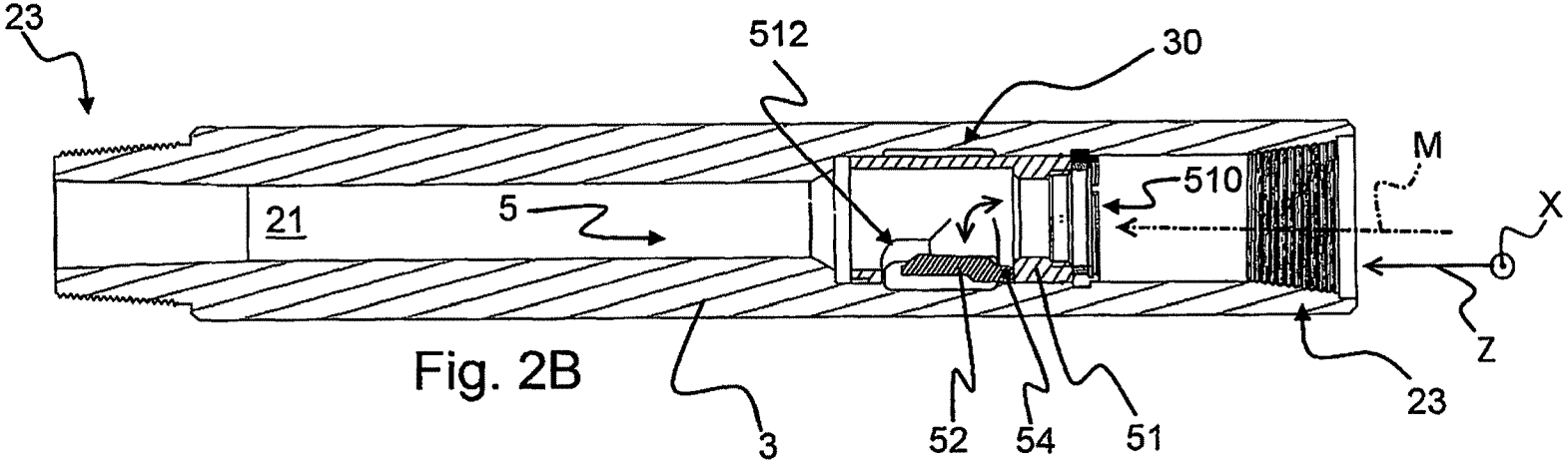

FIGS. 2A and 2B show, by way of non-limiting example, one possible embodiment of a third drilling element 3.

Said third drilling element 3 comprises two connection portions 23 allowing the same third element 3 to be assembled to string "S", and an axial through hole 21 for conducting drilling mud "M".

Inside axial hole 21 there is a housing 30, into which said obstruction element 5 is secured.

In alternative embodiments (not shown), each third drilling element 3 may comprise two or more obstruction elements 5, aiming at improving its capability of dissipating and/or stopping the propagation of a backflow "B".

In general, the obstruction element 5 can be associated with any third drilling element 3, preferably with a tool joint.

Any equivalent embodiments of the third drilling element 3, having at least one obstruction element which in a first configuration obstructs axial hole 21 and in a second configuration restores the same axial hole, should be considered to be comprised in the present description.

Said obstruction element 5 comprises an automatic valve element, comprising at least one obstructor 52. FIGS. 2A and 2B show an obstruction element 5 created by means of a flap valve. In particular, FIG. 2A shows obstruction element 5 in the first configuration, wherein it prevents the propagation of a backflow "B" along string "S". With reference to FIGS. 2A, 2B, 3A and 3B, when the flow is proceeding in the direction concordant with longitudinal axis "Z" towards the bottom of well "W", obstruction element 5 is in the second configuration. If the flow reverses its direction because of layer fluids entering the drilling elements, obstruction element 5 will switch into the first operating configuration, thereby immediately stopping or at least effectively reducing backflow "B". In general, when obstruction element 5 is in the first configuration, any propagation of backflow "B" is preferably prevented.

In such an embodiment, a plate obstructor 52 obstructs the duct formed in valve body 51 comprised in obstruction element 5. Instead, FIG. 2A shows the obstruction element in the second configuration, wherein it allows drilling mud "M" to flow along string "S" towards the bottom of well "W". In this embodiment, obstructor 52 is positioned in a cavity 512 formed in valve body 51.

In general, said obstruction element 5 can consist of any valve assembly that in a first configuration will obstruct axial hole 21 of the drilling element, and in a second configuration will allow, for example, the transit of drilling mud or devices useful for preparing the drilling cycle or other operating steps of a drilling apparatus 1.

Figure 4:
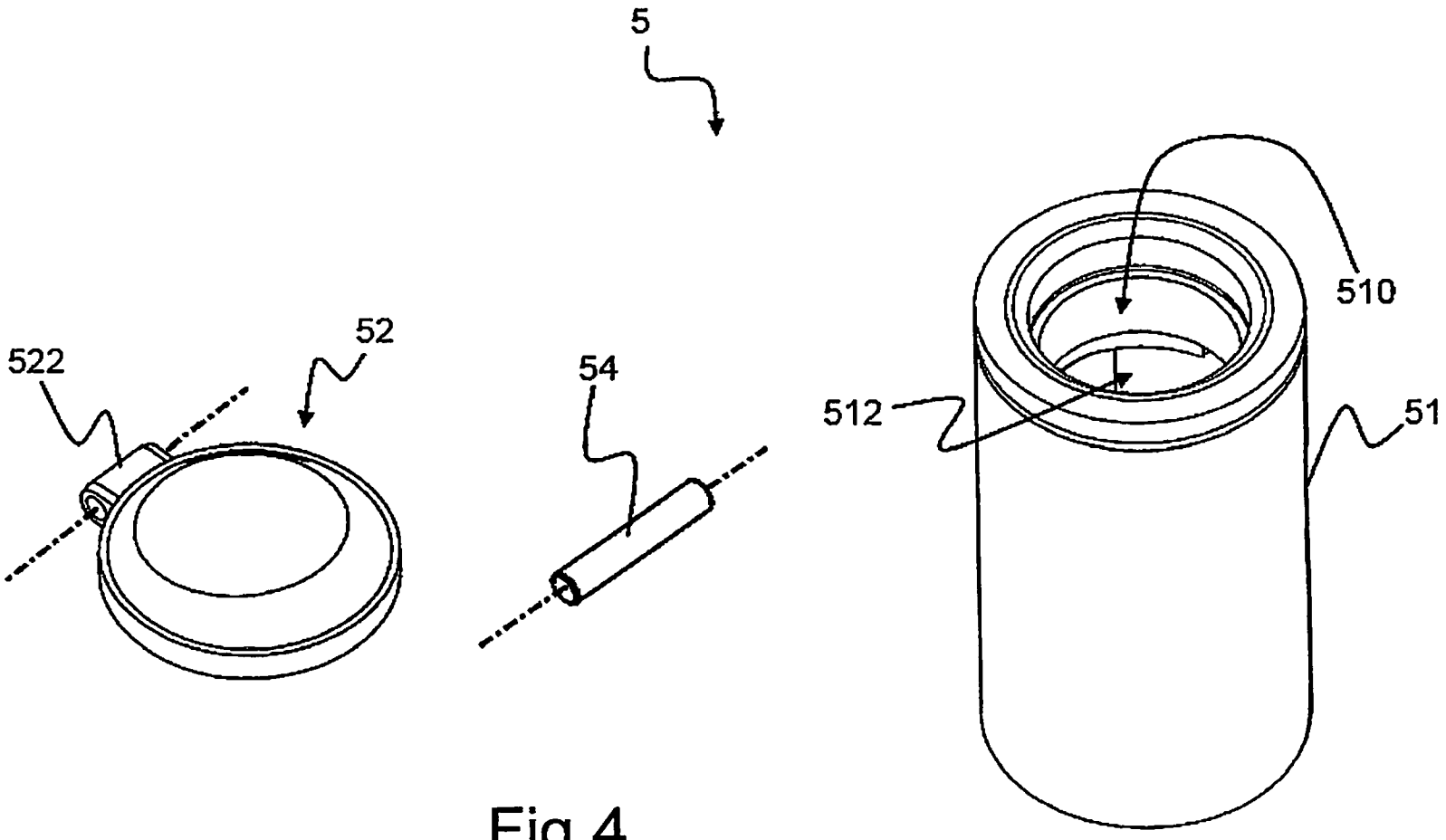
FIG. 4 shows a perspective view of a disassembled obstruction element that can be associated with a drilling element for the use claimed herein.
Figure 5B:
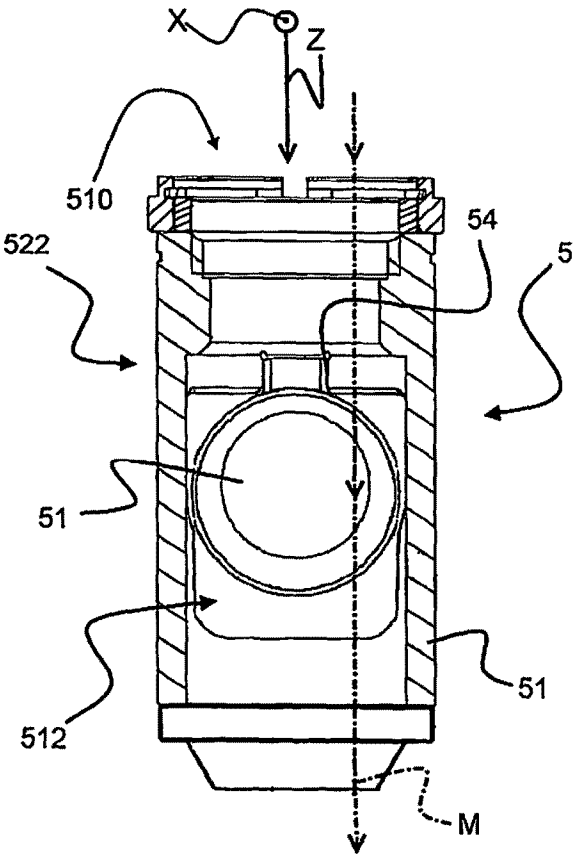
FIGS. 5A and 5B show two different sectional views of an obstruction element in the second operating configuration; in particular.
Figure 5A:
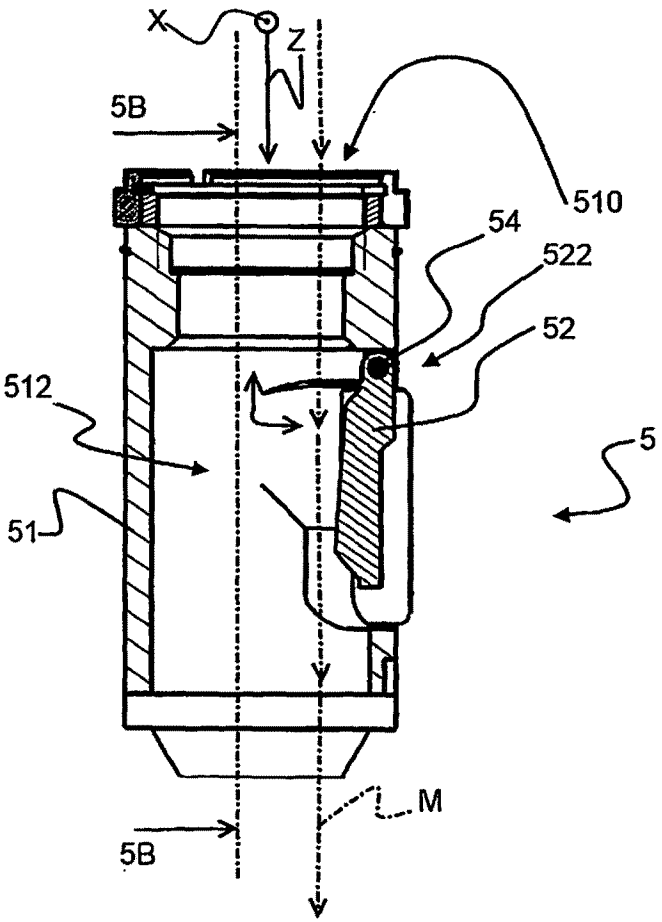

FIGS. 4, 5A and 5B illustrate a preferred but non-limiting embodiment of obstruction element 5.

Said obstruction element 5 is an automatic valve element, comprising a valve body 51 defining a duct 510, and an obstructor 52 for selectively opening and closing said duct 510.

FIG. 4 shows the different parts of obstruction element 5 in the preferred embodiment thereof. Said obstruction element 5 is an automatic valve assembly of the flap type.

In particular, one can see a valve body 51, wherein a duct 510 is defined. Said valve body 51 advantageously has a cylindrical shape in order to adapt itself to the shape of the drilling elements, which are also substantially cylindrical, and in particular to axial hole 21.

In general, duct 510 of valve body 51 has an inside diameter substantially equal to the inside diameter of axial hole 21 of a generic drilling element in use.

In the illustrated embodiment, obstruction element 5 comprises an obstructor 52, which has a plate-like shape for selectively opening and closing duct 510 defined by valve body 51. The same obstructor 52 comprises a coupling element 522 that allows said obstructor 52 to be fixed to valve body 51, e.g. through a pin 54, while still being able to move, e.g. obstructor 52 rotates about said pin 54. In the preferred embodiment, said coupling element 522 comprises a through hole into which a pin 54 can be inserted, so that it can be secured to valve body 51. Obstructor 52 is fastened to valve body 51 through a hinge, so that said obstructor 52 can rotate about the longitudinal axis of pin 54. Once obstruction element 5 has been assembled, the longitudinal axis of pin 54 will be parallel to a transversal axis "X" perpendicular to longitudinal axis "Z". As shown in the drawings, said obstructor 52 is adapted to rotate about pin 54 in order to take the different operating configurations as previously described.

Within valve body 51, as mentioned above, there is a cavity 512 that houses obstructor 52 when obstruction element 5 is in the second configuration, i.e. when it is not obstructing duct 510.

Said cavity 512 is delimited by protuberances, which define the cavity that houses obstructor 52 when obstruction element 5 is in the second configuration. The position of obstructor 52 in cavity 512 does not affect the flow in duct 510 comprised in valve body 51. Although they will not be described in detail herein, the structural characteristics of the exemplary embodiment shown in FIGS. 5A and 5B are comprised in the present description.

The same protuberances that define said cavity 512, shaped like fins, perform the functions of preventing obstructor 52 from seizing inside the cavity, e.g. due to sticking, and of directing a possible backflow "B" into said cavity 512, so as to cause said obstructor 52 to turn about pin 54 and bring obstruction element 5 into the first configuration.

The automatic closing of duct 510 of valve body 51, and hence of axial hole 21 of the third drilling element 3, is ensured by obstructor 52.

Thanks to the use of a flap valve and to the shape of cavity 512 and of the protuberances or fins that define cavity 512, the switching of obstruction element 5 between the two configurations occurs automatically and is dependent on the direction of the flow within the drilling element. In particular, in the case of presence of a flow concordant with the direction of longitudinal axis "Z", i.e. towards the bottom of well "W", said obstruction element 5 will firmly stay in the second configuration; on the contrary, if there is a backflow "B" in the direction opposite to the desired direction towards the bottom of well "W", obstruction element 5 will move into the first configuration, thereby preventing backflow "B" from propagating, or at least attenuating it.

The solution chosen for the switching of obstruction element 5 between the two configurations includes no further structural elements, such as, for example, elastic return elements. Said obstruction element 5 according to the present invention preferably includes only the above-mentioned parts of obstruction element 5. The present solution is dictated by the necessity of using as few elements as possible that might deteriorate and change their functional characteristics over time. In fact, an elastic element such as a return coil spring will wear over time, or accumulated sediments might block the obstructor into one configuration.

It is also preferable that in idle operating conditions, wherein there is no flow in string "S", obstructor 52 will not obstruct duct 510 in valve body 51. In particular, it is preferable to use a normally open valve. For clarity, it must be pointed out that the valve assemblies comprised in the second drilling elements 20, which normally do not reach the BOP device, are normally closed valves, i.e. valves that close the axial hole of the drilling element in idle conditions.

The requirement of using a normally open valve, together with the necessity of obtaining a fast action of obstruction element 5 in the event of the generation of a backflow "B", has led the Applicant to preferably exclude any solutions equipped with return elements, such as springs.

Obstruction element 5 according to the present invention must allow all drilling equipment to pass within string "S", with no limitations whatsoever due to the diameter thereof, in idle conditions, i.e. in the absence of mud circulation, and also while drilling mud "M" is circulating.

Dynamic retaining systems may possibly be employed, in particular non-mechanical ones, such as magnetic retaining devices, e.g. using electromagnets, in particular for ensuring that the first configuration will be held in the event of a backflow with variable pressures.

Said obstruction element 5, and in particular the elements comprised therein, may be made of composite and/or multilayer materials, for the purpose of improving its mechanical strength and reducing its weight. The use of composite materials for making the various parts also allows to improve the production process and to obtain the desired shapes.

In order to further improve their resistance to wear, the various parts of obstruction element 5 may be subjected to at least one surface process. Surface processes may be one or more of the following surface treatments: TD or Toyota Diffusion process; thermoreactive diffusion; chemical nickelling; nitridation, vapour phase deposition.

The composite material employed is based on boron carbide and aluminium, with low percentages of graphite.

For the purposes of the present invention, the term low percentages refers to percentages of less than 5% of the total.

In an exemplary and non-limiting embodiment, pin 54 is made of composite material, preferably based on boron carbide ($B_4C$) and aluminium (Al), with small quantities of graphite.

In order to further reduce the weight of the obstructor and thus make it more sensitive to changes in the direction of the flow in axial hole 21 of string "S", it may employ a nylon-filled cavity or an aluminium obstructor subjected to a surface coating process for increasing its resistance to abrasion. Such a surface process, combined with the use of the above-mentioned new materials, will improve the operation of obstruction element 5, providing better performance and less wear.

Other solutions aimed at improving the sensitivity of obstruction element 5 to flow variations may employ bearing-mounted bushings for the movable parts.

A further aspect of the present invention relates to the use of an obstruction element 5 for closing axial hole 21 of a drilling element to be used for deepwater or ultra-deepwater drilling. Said obstruction element 5 is used in a novel and innovative manner compared to the solutions known in the art, as previously specified.

Said obstruction element 5 is comprised in a drilling element, in particular a third element 3, assembled in series to a string "S" of drilling elements, as already mentioned. Said obstruction element 5 is assembled in series to said string "S" in such a way that it is located between the bottom of a drilling well "W" and a blowout preventer or BOP 4 during the drilling cycles carried out by a drilling apparatus 1 in deep or ultra-deep waters.

The use of obstruction element 5 for deepwater and/or ultra-deepwater drilling is particularly effective when said drilling element, in particular the third drilling element 3, which comprises said obstruction element 5, is located after, preferably immediately after, initial portion 15.

Moreover, the use of obstruction element 5 for deepwater and/or ultra-deepwater drilling is also particularly effective when said drilling element, in particular the third drilling element 3, which comprises said obstruction element 5, is arranged at regular intervals along drill string "S".

The use of multiple obstruction elements 5 along string "S" improves the obstruction performance of the various obstruction elements 5, ensuring that, at blowout preventer or BOP 4, the pressure inside string "S" will be lower than the nominal working pressure, preferably equal to or lower than the atmospheric pressure, as already discussed herein in detail.

FIG. 1 shows a classical connection diagram of drilling elements making up a string "S" for deepwater drilling, wherein the depth of bottom or bed "G" from the water level is greater than or equal to the design drilling depth of well "W". Said obstruction element 5 according to the present invention is particularly suitable for use in the drilling conditions shown in FIG. 1.

In FIG. 1 one can see blowout preventer or BOP 4 on bottom or bed "G", at a great distance from floating structure 11 of drilling apparatus 1. As aforementioned, and as known to a man skilled in art, a blowout preventer or BOP 4 comprises shearing devices and clamping devices, the operation of which is known to a man skilled in the art.

Should cement circulations or plugs, etc. need to be provided by using open-end drill pipes, said third drilling element 3 comprising said obstruction element will have to be assembled to the initial first drilling element 2 running into the well. In drilling jargon, the term "open-end" drill pipes refers to a drill string formed by pipes only, i.e. lacking the bottom hole assembly comprising a drill bit, drill collars, stabilizers. Said string, comprising drilling elements only, such as drill pipes, is a solution that is used for cement circulation or plug-making operations, as known to a man skilled in the art.

In this embodiment, said lower portion 15 is a drilling element, e.g. a first drilling element 2, to which a third drilling element is assembled. In an alternative embodiment (not shown), said step s) is also carried out prior to said step a), so that the first module of string "S" will be a third drilling element 3 comprising an obstruction element 5, which will thus become the lower portion of the string.

For the purposes of the present invention, a module is a generic drilling tool joint arranged in string "S".

The use of obstruction element 5 according to the present invention prevents the problem of backflows "B" within string "S", which might cause blowouts, and allows cutting the drilling elements, by means of said blowout preventer or BOP 4, in optimal conditions.

Obstruction element 5 according to the present invention moves along well "W" during the various operating steps carried out by drilling apparatus 1, ensuring a high level of safety because, in the event of a reversal of the flow in well "W", e.g. caused by layer fluids running within the drilling elements, said obstruction element 5 will obstruct said axial hole 21, thus stopping backflow "B" from propagating in the unwanted direction. The present solution allows the blowout preventer or BOP 4 to perform its shearing action correctly.

Obstruction element 5 according to the present invention intervenes automatically, ensuring the closure of the inner duct of string "S". Moreover, through the use of obstruction element 5, well "W" can be kept safe after the operations for closing it, e.g. after the cutting of the drilling elements carried out by the blowout preventer or BOP 4.

As already specified, the use of obstruction element 5 as claimed herein results in a controlled pressure at the shearing elements of blowout preventer or BOP 4. The use of said obstruction element 5 avoids the generation of an anomalous internal pressure in string "S", equal to the pressure generated by the kick, which might adversely affect the cutting of the same drilling elements.

The method of assembly of drilling elements and the use of said obstruction element 5 positioned under blowout preventer or BOP 4, during the drilling cycle carried out by drilling apparatus 1, prevents a possible backflow "B", which might cause a blowout, from propagating through the inside of the drilling elements, or at least from propagating out of wellhead "H".

Furthermore, the present invention ensures that the portion of string "S" in front of the shear rams of blowout preventer or BOP 4 will always have a controlled pressure, in particular lower than the nominal working pressure, preferably substantially equal to the atmospheric pressure, in particular the pipe having an internal/external differential pressure such that the cutting of the same drilling element will be facilitated and safe.

The method and the use according to the present invention allow safeguarding the life of the crew of the drilling rig as well as the environment, thus significantly improving the safety of oil-well drilling operations.

REFERENCE NUMERALS

Drilling apparatus 1
Floating structure 11
Mast 12
Initial string portion or BHA 15
First drilling elements 2
Second drilling elements 20
Axial hole 21
Connection portion 23
Third drilling element 3
Housing 30
Blowout preventer or BOP 4
Obstruction element 5
Valve body 51
Duct 510
Cavity 512
Obstructor 52
Coupling element 522
Pin 54
Backflow B
Bottom or bed G
Wellhead H
Drilling mud M
String S
Extension T0
First section T1
Second section T2
Drilling well W
Transversal axis X
Longitudinal axis Z

The invention claimed is:

1. A method of assembly of a string of drilling elements for deep water drilling, wherein a depth of a body of water is at least 550 meters;

each drilling element including at least one axial through hole, through which drilling mud can flow in at least a first direction, and two connection portions for connecting the drilling element in series in said string;

the method comprising the following steps:

a) assembling a lower portion of the string as a bottom hole assembly;

b) providing at least one first drilling element;

c) assembling said at least one first drilling element with another one of said at least one first drilling element to begin the assembly of first drilling elements to create a first section of the string directed towards a bottom or bed of the body of water, where a blowout preventer is located;

d) repeating said steps b)-c) to create the first section of the string until said lower portion is in proximity of the blowout preventer or until said lower portion is in proximity of the bottom or bed, and the string having a length of at least 550 meters;

e) beginning the assembly of second drilling elements while a drilling apparatus is carrying out a drilling cycle, for creating at least a second section of the string used in conjunction with the first section of the string during the drilling cycle;

f) repeating said step e) until the second section of the string has reached an extension length at least equal to a desired drilling depth of a drilling well;

g) assembling at least one third drilling element, the at least one third drilling element comprising at least one obstruction element for preventing a backflow from being generated against the first direction of drilling mud in said string;

wherein said step g) of assembling at least one third drilling element is carried out after said step a) of assembling a lower portion of the string and before said step b) of providing at least one first drilling element.

2. The method according to claim 1, wherein, during execution of the sequence of said steps b)-d), carrying out at least one further step g) of assembling the at least one third drilling element.

3. The method according to claim 2, wherein said further step is carried out at regular intervals.

4. The method according to claim 3, wherein said further step is carried out after the step b) of providing at least one first drilling element is executed at least twice.

5. The method according to claim 1, wherein a distance between two of said at least one third drilling element is between 28 m and 500 m.

6. The method according to claim 1, comprising a check step, prior to the step d) of repeating said steps b)-c) until said lower portion is in proximity of the blowout preventer or until said lower portion is in proximity of the bottom or bed;

in said check step, verifying if the assembly of said first drilling elements has reached an extension length which is at least equal to a predefined design drilling depth of the drilling well;

said verifying is carried out during the cycle executed in said check step.

7. The method according to claim 1, wherein said obstruction element comprises an automatic valve element, comprising at least one obstructor.

8. The method according to claim 1, wherein said obstruction element comprises an automatic valve element having a valve body defining a duct, and an obstructor for selectively opening and closing said duct;

said obstructor comprises a coupling element for securing said obstructor to the valve body through a pin about which the obstructor can rotate;

said obstruction element is made of composite and/or multilayer material.

9. The method according to claim 8, wherein all parts of the obstruction element are subjected to at least one surface process for improved resistance to wear.

10. The method according to claim 9, wherein the surface processes are one or more selected from:

TD, or Toyota Diffusion, process;

thermoreactive diffusion;

chemical nickelling; or vapor phase deposition.

11. The method according to claim 8, wherein said obstruction element only includes:

an automatic valve element having a valve body defining a duct; and an obstructor for selectively opening and closing said duct, comprising a coupling element for securing said obstructor to the valve body through a pin, the obstructor being rotatable about the pin;

said obstruction element is made of composite and/or multilayer material.

12. The method according to claim 1, said second drilling elements being adapted to allow continuous circulation of the drilling mud, during all operating stages of the drilling cycle carried out by the drilling apparatus;

said second drilling elements being different compared to said first drilling elements and said third drilling elements.

13. The method according to claim 12, wherein said second drilling elements comprise at least one normally closed valve assembly.

14. The method according to claim 12, wherein said obstruction element comprises a normally open valve.

15. The method according to claim 1, wherein said obstruction element comprises a normally open valve.

16. A method of using an obstruction element, said obstruction element comprising in a drilling element arranged in series in a string of drilling elements, assembled according to the method of claim 1, the string being assembled as to be placed in said string between a bottom of a drilling well and a blowout preventer or BOP during a deep water or ultra-deep water drilling cycle carried out by a drilling apparatus, the method comprising closing an axial hole of said drilling element employed for deep water and ultra-deep water drilling.

17. The method according to claim 16, wherein said drilling element comprising said obstruction element is arranged at regular intervals along the string of drilling elements.

* * * * *